US005284194A

United States Patent [19]

Gaffney

[11] Patent Number: 5,284,194

[45] Date of Patent: Feb. 8, 1994

[54] GOLF CLUB HEAD AND SHAFT COVER

[75] Inventor: John H. Gaffney, Scottsdale, Ariz.

[73] Assignee: Arizona Manufacturing & Embroidery, Inc., Tempe, Ariz.

[21] Appl. No.: 76,627

[22] Filed: Jun. 15, 1993

[51] Int. Cl.[5] ..... A63B 57/00

[52] U.S. Cl. ..... 150/160; 206/315.2

[58] Field of Search ..... 150/154, 160, 162, 165; 206/315.2, 315.4

[56] References Cited

U.S. PATENT DOCUMENTS

| | | | |
|---|---|---|---|
| 2,014,589 | 9/1935 | Saad | 206/315.4 |
| 3,667,078 | 6/1972 | Distasio | 206/315.4 X |
| 3,938,570 | 2/1976 | Stewart | 150/160 |
| 3,977,451 | 8/1976 | Duba | 206/315.4 |
| 4,497,404 | 2/1985 | Lowrance | 150/160 X |
| 5,168,909 | 12/1992 | Joyner, Jr. | 150/160 |
| 5,220,950 | 6/1993 | Cordasco | 206/315.4 X |

*Primary Examiner*—Allan N. Shoap
*Assistant Examiner*—Christopher J. McDonald
*Attorney, Agent, or Firm*—LaValle D. Ptak

[57] ABSTRACT

A golf club head cover for use with golf clubs having graphite shafts has a generally cylindrically shaped head cover for the head of a golf club. This head cover has an upper end and a lower end. The upper end is closed, and the lower end is open. An elongated shaft protector is secured to the inside of the head cover at a point intermediate the upper and lower ends, to extend outwardly through the open lower end and downwardly along the shaft of a golf club inserted into the cover. This shaft protector portion is an elongated tapered element, which has mating closures along the opposite edges. When the shaft protector is open, the golf club head easily is inserted into the head cover portion and the shaft is placed between the open edges in the shaft protector. After the shaft is in place, the shaft protector is closed over the shaft to hold the head cover and shaft protector on the golf club as a unit. By extending the shaft protector from a point intermediate the upper and lower ends of the head cover, the head cover has the appearance of "floating" with respect to the shaft protector part of the cover assembly.

10 Claims, 2 Drawing Sheets

GOLF CLUB HEAD AND SHAFT COVER

BACKGROUND

Padded covers have been used for a number of years to protect the heads of golf clubs from banging into one another when they are carried in a golf bag. Typically, these head covers are made of soft, padded bulky material, and extend around the head and a relatively short distance over the end of the shaft where it attaches to the head. These head covers are closed at the top end (when the club is in the bag) and are open at the lower end, from which the shaft extends. The opening is relatively wide, and permits easy placement of the cover on the club head, and removal of the cover from the club head when that particular club is desired for use in the play of the game of golf.

Head covers of the type described above have been considered adequate for golf clubs which employ steel shafts. The advent of graphite shafts, however, has created a need to protect the portion of the shaft, which extends outwardly from the top of a golf bag, against contact with the heads of uncovered clubs or from contact with the shafts of adjacent clubs. Additional wear also is produced from the golf bag dividers rubbing against the shafts while the golf cart is bouncing along or the bag shifts as a golfer walks along. This produces a "rub ring" around the shaft. Graphite shafts are more prone to scratching and nicking than metal shafts; and most golfers desire to reduce the potential for marring of the finish of the graphite shafts of their clubs to as great an extent as possible.

Efforts to protect the exposed portions of graphite shafts from damage, when clubs are being transported or stored in a golf bag, have resulted in a modification of the golf club head cover by sewing a "knit sock" into the opening at the bottom of the head cover. The sock extends downwardly from the head cover opening, and terminates in a slightly enlarged end for the ingress and egress of a golf club head and shaft. Essentially, this "sock" is an elongated open-ended tube, the upper end of which is secured all around the bottom end of the head cover. To provide the necessary amount of protection without excess bulk, the sock has to have a relatively small internal diameter in its relaxed position. This effectively is provided by means of elongated ribs of the type employed in socks for personal wear.

While such knit sock-like shaft covers, attached to the head cover, theoretically provide the desired protection, a number of disadvantages exist. One of the major problems is that it is difficult to insert a club into the combined sock and head cover for storage, since the club head must be inserted through the open lower end of the sock, and then the entire unit must be stretched and pulled downwardly until the club head is secured inside the upper end of the head cover. The sock then must be pulled down around the shaft; and the golf club then may be stored in the golf bag.

Frequently, when the golf club is dropped into the golf bag, the bottom end of the sock shaft protector catches the edge of the bag, or dividers across the opening in the bag, and is pushed up toward the bottom end of the head cover. This is inherent in the material out of which such shaft protector "socks" must be made, since they need to be very flexible in order to permit the passage of a golf club head through them into or out of the head cover. Whenever the sock, however, is pushed up from its lowermost position, it is possible to expose a part of the graphite shaft above the lip of the golf bag, subjecting the shaft to possible scratching and marring.

Another problem which exists with "sock" type head covers is that the knit socks wear out rapidly. This is a result of the friction encountered when the head cover is placed on the head of a golf club and is removed from the head of a golf club.

Another disadvantage of the "sock" type shaft protectors, described above, is that since they are attached to the open end of the head cover, the sock tends to pull the cover to one side or the other to spoil the "balanced" look, which otherwise is obtained by head covers which do not have this additional "sock" shaft protector attached to them. While this might be considered a minor disadvantage, embroidered logos frequently are put on the head covers to promote a particular golf club or other products, and distortion or interference with the ideal appearance of these head covers is considered unacceptable.

An additional disadvantage of the sock type head covers is that if one is dropped on the ground, the golfer must bend over to pick it up, since the sock prevents the end of a golf club from being inserted into the bottom end of the cover to lift it from the ground. In contrast, a standard head cover, not having a shaft protector sleeve or "sock" on it, easily may be lifted by inserting the head of a club into it without requiring the golfer to bend over to pick up the cover.

It is desirable to provide a combination head cover and shaft protector for a golf club, which overcomes the disadvantages of the prior art devices noted above, and which is simple to use, attractive in appearance, and long lasting.

SUMMARY OF THE INVENTION

It is an object of this invention to provide an improved golf club head cover.

It is another object of this invention to provide an improved golf club head cover with a shaft protector sleeve on it.

It is an additional object of this invention to provide an improved combined golf club head cover and shaft protector, as a unitary device, which facilitates removal of a golf club from the device and the insertion of a golf club into the device.

It is a further object of this invention to provide an improved combined golf club head cover and shaft protector in which the shaft protector is attached to the head cover portion in a manner which causes the head cover to remain centered over the shaft protector.

In a preferred embodiment of the invention, a golf club head cover is constructed as a generally cylindrically shaped cover, with an upper end and a lower end. The upper end is enclosed, and the lower end is open. An elongated shaft protector is secured to the inside of the head cover at a point intermediate the upper and lower ends, and then extends downwardly a predetermined distance below the lower end of the head cover. This causes the head cover to appear to float on the shaft protector.

BRIEF DESCRIPTION OF THE DRAWINGS

FIG. 9 is a perspective view of applicant's preferred embodiment shown in a position of use;

DETAILED DESCRIPTION

Figures 1, 2, 3, 10:
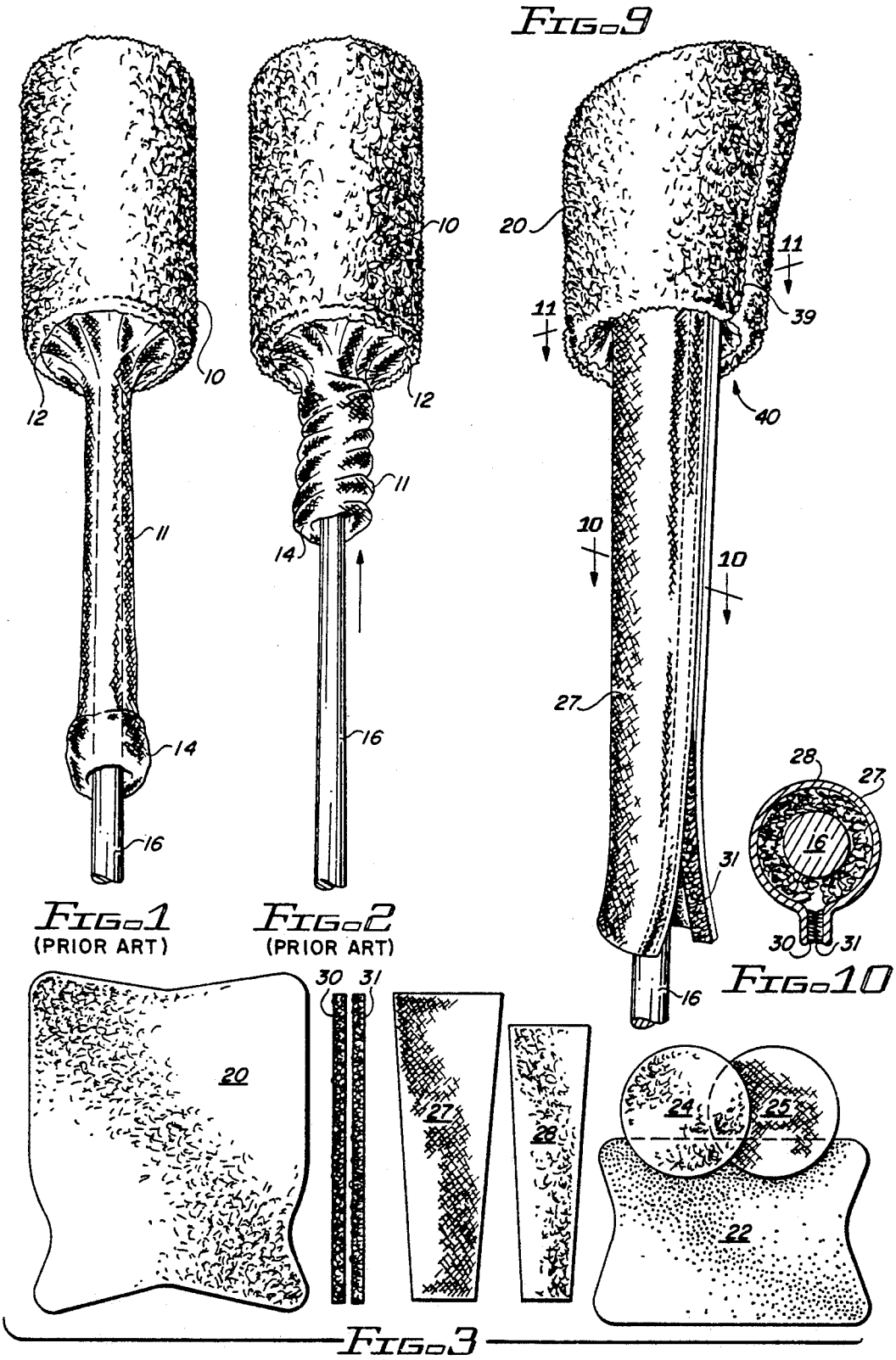
FIG. 1 (PRIOR ART)
FIG. 2 (PRIOR ART)
FIGS. 1 and 2 illustrate a prior art combination golf club head cover/shaft protector.
FIG. 3 is an exploded view of the various unassembled parts of a preferred embodiment of the invention.
FIG. 10 is a cross-sectional view taken along the line 10—10 of FIG. 9.

Reference now should be made to the drawings, in which the same reference numbers are used throughout the different figures to designate the same components. Reference first should be made to FIGS. 1 and 2. These figures illustrate a typical prior art combination head cover and shaft protector, of the type sometimes referred to as a "tadpole" head cover. This head cover includes an enlarged upper portion 10, which is in the form of a generally hollow cylindrical member with a closed upper end, and an open bottom end. The bottom edge 12 then is secured to one end of an elongated open-ended cylindrical knit sock-like member by stretching the end of the sock outwardly to attach it to the bottom end 12 of the head cover portion 10 of the device. The lower end of the sock-like portion 11 generally has an outwardly flared end 14 on it. This end has an opening in it which is somewhat greater than the relaxed internal cross-sectional opening of the main portion of the soft knit sock-like shaft protector part 11.

When the device is placed on a golf club shaft 16, ideally, it should have the configuration shown in FIG. 1; so that when it is placed in the golf bag, the upper end of the shaft 16, which extends through the interior of the protector 11 into the head cover portion 10, is covered. It should be noted, that in order to place the head cover 10 over the head of a golf club, the rather large head first must be inserted through the opening 14, and then be pulled through the interior of the part 11 of the sock-like knit fabric until it enters into the hollow interior of the head cover portion 10. The sock then is pulled downwardly, by hand, to the position shown on the shaft 16 in FIG. 1.

When removal of the head cover of FIG. 1 is desired, the entire device must be pulled over the head cover, allowing the head to stretch out the main body portion 11 of the sock-like shaft protector until the head is pulled out of the open lower end 14 of the protector 11. This causes a substantial amount of friction and wear on the shaft protector 11. It also requires a considerable amount of effort both to insert a golf club head into the device, and to remove it from the device.

In FIG. 2, the head cover/shaft protector prior art device of FIG. 1 is illustrated in a configuration which it frequently attains when the end of the shaft 16 is dropped into a golf bag. Frequently, the edge of the golf bag, or partitions across the opening of the golf bag, catch the lower end 14 of the shaft protector part of the sock 11, and push it upward by bunching it, as illustrated in FIG. 2. When this happens, the portion of the shaft 16 which is exposed below the bunched-up end 14 of the shaft protector 11 is subject to nicks and scratches from other shafts and clubs stored in the golf bag in which the device is placed.

Reference now should be made to FIG. 3, which is an exploded view of various parts which are assembled together as shown in FIGS. 5 through 8 to form the preferred embodiment of the head cover/shaft protector of this invention. As illustrated in FIG. 3, the main part of the head cover portion of the preferred embodiment is a generally rectangularly shaped piece of material 20, which usually is formed of a relatively high pile "fuzzy" material to give a bulky look, and to provide a padded protection for a golf club head. As is explained subsequently in the description of FIG. 4 through 8, this material is further padded by means of a foam insert 22. Back-to-back circular disks 24 and 25, also made of high pile material, are placed in the upper end to form the top of the head cover portion of the combination head cover/shaft protector.

Figure 4:
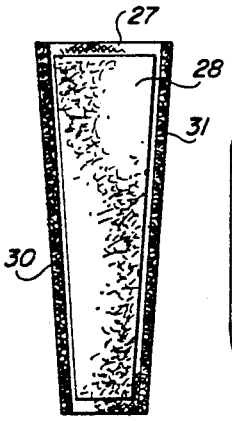
FIG. 4 is a detailed view of a partial assembly of some of the parts of FIG. 3.

The shaft protector portion is in the form of an elongated, nearly rectangular member (or elongated trapezoidal member) 27, made of a material which is relatively stiff, particularly compared to the soft knit sock portion 11 of the prior art device. The material 27 typically is a woven nylon material or the like. To provide a padded protection for the shaft of a golf club, a padded soft insert 28 is sewn into place in the center of the outer material 27, as illustrated in FIG. 4. A pair of mating hook and loop fasteners, which may be Velcro® hook and loop portions 30 and 31, are sewn on the opposite elongated edges of the main material 27, as illustrated in FIG. 4. These additional Velcro® strips, along with the bulk provided by the fabric piled cushion portion 28, cause the elongated trapezoidal shaft protector assembly 27 to 31 to be relatively rigid, while at the same time exhibiting some flexibility as a result of the structure being made entirely of different layers of fabric.

Figure 5:
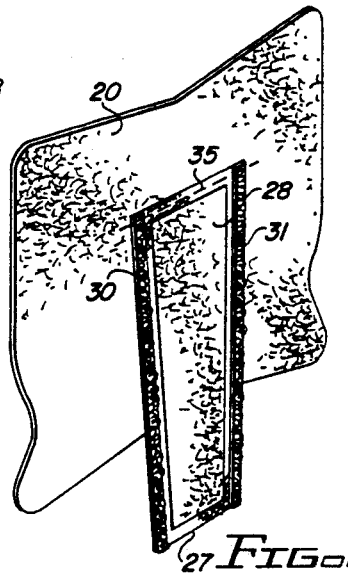
FIG. 5 illustrates a sub-assembly of the parts of FIG. 4, with another one of the parts of FIG. 3.

In the construction of the composite golf club head cover/shaft protector, the next step is to sew the top edge of the assembly of FIG. 4 onto the open fabric sheet 20 in the position shown in FIG. 5. As is apparent from FIG. 5, this sewn edge 35, for the assembly 27 to 31, is located above the half-way line through the center of the piece 20. After the sewn edge 35 has been completed, the piece 20 is folded upwardly to the position shown in FIG. 6, and the foam insert 22 is placed between the folded up portions to form a sandwich, generally as shown in FIG. 6.

Figure 6:
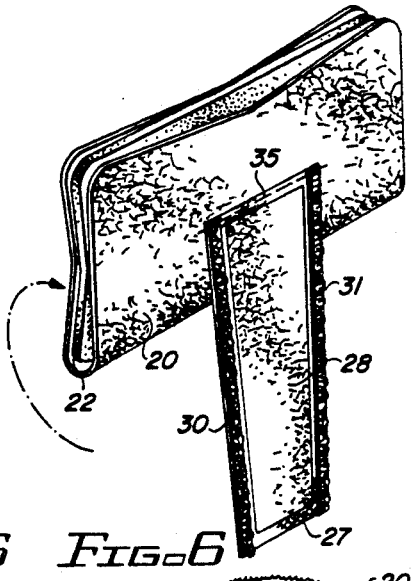
FIG. 6 illustrates assembly of others of the parts of FIG. 3 in the construction of applicant's preferred embodiment.
Figure 7:
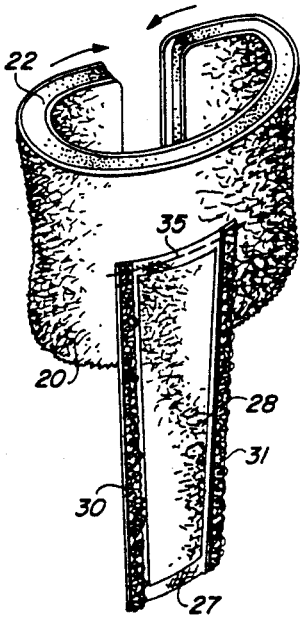
FIG. 7 illustrates another step in the construction of the preferred embodiment.
Figure 8:
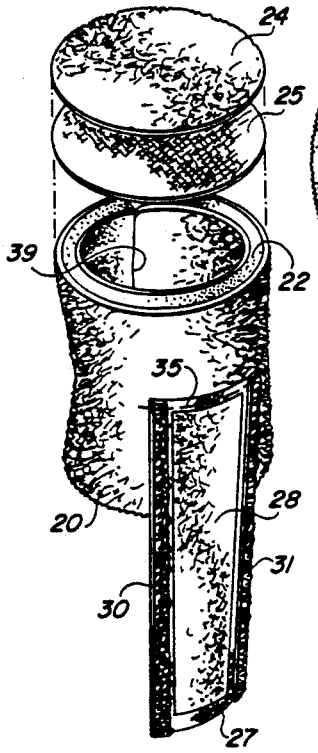
FIG. 8 illustrates a final assembly step in the construction of applicant's preferred embodiment.

After the assembly step of FIG. 6 is completed, the outer ends of the member 20 are folded around in a circle toward one another in the direction of the arrows shown in FIG. 7. These edges are sewn together at a seam 39 to form a generally tubular or open-ended cylindrical head cover portion, as illustrated in FIG. 8. After the seam 39 has been sewn to assemble the sub-assembly to the configuration shown in FIG. 8, the pile fabric circles 24 and 25 are placed back-to-back and sewn onto the top of the open end of the device of FIG. 8, as indicated.

Figure 12:
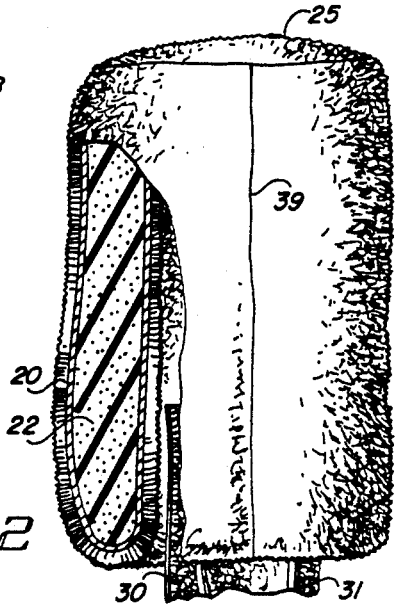
FIG. 12 is a partially cut away view of a fully assembled preferred embodiment shown in FIG. 9.

After the complete assembly, discussed above in conjunction with FIG. 8, is finished, the device is turned inside out; so that the seam 35 and the shaft protector portion 27 to 31 now are located on the inside of the head cover portion 20 of the device, and extend downwardly out of the open lower end of the head cover portion, as illustrated in the partially cut away view of FIG. 12. It is to be noted that when the device is turned inside out, the width of the upper end of the shaft protector portion 27 to 31 extends around only a portion of the interior diameter of the upper head cover portion 20 of the assembly.

When no golf club is located in the head cover portion, the shaft protector part remains open, as illustrated in FIG. 12. Consequently, it is simple to insert a golf club head in the device, since it may be inserted into the open end of the upper portion 20 without the necessity of passing it upwardly through the shaft protector part of the device. Once the golf club head is in place inside the upper head cover portion 20, the shaft protector 27–31 is pushed around the shaft 16, as shown in FIG. 9, and the hook and loop fastener 30, 31 is squeezed around the shaft 16 and closed, simply by sliding the hand downwardly from head cover portion along the shaft. In FIG. 9, this is illustrated by showing the upper part of the shaft protector portion 27–31 fully closed, with the lower portion still open. When the shaft protector 27–31 is fully closed, it assumes a sleek uniform configuration all the way to its lower end, fully surrounding the golf club shaft 16.

Figure 11:
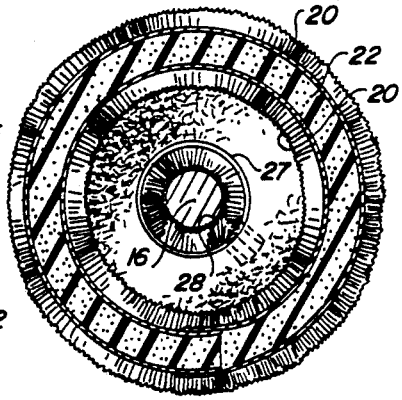
FIG. 11 is a cross-sectional view taken along the line 11—11 of FIG. 9.

FIGS. 10 and 11 show the cross sectional configuration which is assumed by the different parts when a golf club shaft 16 extends through the protector portion 27–31 and up into the lower end of the head cover portion 20 of the assembly.

The shaft protector 27–31 resists bunching or upward movement on the shaft 19 due to the nature of the composite materials used, which cause it to be somewhat stiff when it is placed in position around a shaft 16. Consequently, problem which exists with the prior art sock device, as illustrated in FIG. 2, does not occur. Even if the lower end of the closed shaft protector 27–31 engages the edge of a golf bag or one of the dividers in the golf bag, the protector 27–31 simply will bounce away and then slide down into the golf bag, along with the shaft.

When a player desires to remove a golf club from the device shown in FIG. 9, all that is necessary is to pull downwardly on the shaft 16 while holding the head cover with the other hand. The golf club head then peels apart the hook and loop fasteners 30, 31 to open the shaft protector fully, for removal of the golf club and shaft. Alternatively, the shaft protector may be opened to remove a golf club by simply sliding a finger down the hook and loop fastener 30, 31 between the shaft opening and the shaft. After this is done, the golf club head may be slid out of the top head cover portion 20. Either of these methods, however, is clearly superior to the prior art sock device, where the head had to be pulled through the sock, either to put on the head cover or remove it.

Another advantage of the head cover/shaft protector device shown in FIGS. 5 through 12 is that if the device is dropped after a club has been removed, it easily may be picked up by a golfer simply inserting the head of the golf club into the open lower end of the head cover 20 adjacent the shaft protector 27–31, and lifting the head cover up in the same manner as is possible with a standard head cover having no shaft protector on it. This is not possible with the prior art device shown in FIGS. 1 and 2.

Another advantage of the head cover/shaft protector device, illustrated most clearly in FIG. 9, is that by attaching the shaft protector part of the assembly part of the way up into the inside of the head protector cover 20, the shaft protector portion 27–31 extends out of the open end 40 of the head cover, and causes the appearance of a "floating" head cover over the upper or inside end of the shaft protector 27–31. This causes the appearance of the head covers, when they are all placed in the bag, to be attractive and to closely approximate the appearance of head covers placed on golf clubs which do not have a shaft protector on them. This is an aesthetic advantage.

The foregoing description of the preferred embodiment of the invention should be considered as illustrative, and not as limiting. Various changes and modifications will occur to those skilled in the art, without departing from the true scope of the invention as defined in the appended claims. For example, although a particular mating fastener has been described, other fasteners may be used if desired. For example, zippers may be employed, and snaps, buttons or other fasteners could be used, although the hook and loop type of fastener is preferable, because of its ease of use. Even so, other types of fasteners could be used if desired. Various types of materials, which exhibit the desired characteristics also may be substituted without departing from the scope of the invention as claimed.

I claim:

1. An improvement in a golf club head cover including in combination:

a generally hollow cylindrically shaped head cover for the head of a golf club, said head cover having an upper end and a lower end, said upper end closed and said lower end open; and an elongated shaft protector having a predetermined length and made of flexible material secured to the inside of said head cover at a point intermediate said upper and lower ends thereof and extending downwardly through said open lower end of said head cover a predetermined distance below said lower end of said head cover, said shaft protector being normally open throughout the length thereof and including closure means thereon for closing said shaft protector around a shaft of a golf club.

2. The combination according to claim 1 wherein said elongated shaft protector is a generally elongated rectangular member, having an upper end and a lower end and first and second edges, said elongated rectangular member secured at the upper end thereof to the inside of said head cover, with the width of the upper end of said shaft protector at the upper end thereof being less than the internal diameter of said hollow cylindrically shaped head cover.

3. The combination according to claim 2 wherein said closure means is located on at least one of said first and second edges of said shaft protector for closing said shaft protector around a shaft of a golf club.

4. The combination according to claim 3 wherein said closure means comprises mating closure members on said first and second edges of said elongated rectangular member.

5. The combination according to claim 4 wherein said mating closure members comprise the hook portion of a hook and loop closure on said first edge of said rectangular member and the loop portion of a hook and loop closure on said second edge of said rectangular member.

6. The combination according to claim 5 wherein said generally elongated rectangular member is an elongated tapered member the lower end of which is of less width than the upper end thereof.

7. An improvement in a golf club head cover including in combination:

a generally hollow cylindrically shaped head cover for the head of a golf club, said head cover having an upper end and a lower end, said upper end closed and said lower end open; and an elongated shaft protector in the shape of a generally elongated rectangular member, having an upper end and a lower end and first and second edges, said elongated rectangular member secured at the upper end thereof to the inside of said head cover at a point intermediate said upper and lower ends thereof and extending downwardly through said open lower end of said head cover a predetermined distance below said lower end of said head cover, the width of the upper end of said shaft protector at the upper end thereof being less than the internal diameter of said hollow cylindrically shaped head cover.

8. The combination according to claim 7 wherein said generally elongated rectangular member is an elongated tapered member the lower end of which is of less width than the upper end thereof.

9. The combination according to claim 8 wherein said elongated shaft protector is made of material which resists movement upwardly on a golf club shaft toward said head cover.

10. The combination according to claim 9 further including closure means on at least one of said first and second edges of said shaft protector for closing said shaft protector around a shaft of a golf club.

* * * * *